United States Patent [19]

Cheng

[11] 4,219,153

[45] Aug. 26, 1980

[54] MODEL VEHICLE TRACK SECTION

[76] Inventor: Richard C. M. Cheng, Suite 1604, Austin Center, Austin Ave., Kowloon, Hong Kong

[21] Appl. No.: 969,106

[22] Filed: Dec. 13, 1978

[51] Int. Cl.[2] ..... A63H 19/30

[52] U.S. Cl. ..... 238/10 E; 104/DIG. 1

[58] Field of Search ..... 238/10 A, 10 B, 10 C, 238/10 E, 10 F; 104/60, 147 A, DIG. 1; 46/1 K, 216

[56] References Cited

U.S. PATENT DOCUMENTS

| | | | |
|---|---|---|---|
| 2,764,357 | 9/1956 | Katryniak | 238/10 C |
| 4,066,211 | 1/1978 | Mak | 238/10 F |

FOREIGN PATENT DOCUMENTS

| | | | |
|---|---|---|---|
| 1255547 | 11/1967 | Fed. Rep. of Germany | 238/10 A |
| 1256127 | 12/1967 | Fed. Rep. of Germany | 238/10 E |
| 1255076 | 1/1961 | France | 238/10 E |

*Primary Examiner*—Randolph A. Reese

*Attorney, Agent, or Firm*—Robert K. Youtie

[57] ABSTRACT

A track section for model trains and the like including a non-conductive bed supporting a pair of conductive rails, the bed including on each end an extension and receiver for entry into and reception of end receivers and extensions of like beds, resilient formations for snap interfitting engagement between like track beds, and rail connectors for electrical conduction between rails of adjacent beds.

7 Claims, 7 Drawing Figures

MODEL VEHICLE TRACK SECTION

BACKGROUND OF THE INVENTION

In the past there have been proposed model train track constructions which effectively resist disconnection by vibration in use, are entirely safe against laceration and the like by eliminating sharp projections, and avoid problems from the falling off or inadvertent removal of conductive rail joiners. However, prior proposed model train track constructions have not satisfactorily overcome these problems.

SUMMARY OF THE INVENTION

Accordingly, it is an important object of the present invention to provide a model train track construction which overcomes the above mentioned difficulties, is entirely safe in eliminating protrusions capable of causing injury, is entirely resistant to vibrations inherent even in abusive model train track operation so as to remain connected under substantially all conditions of use without requiring nailing or other positive securement to a layout board, and further wherein rail joiners are effectively self-anchoring to desired rail ends so as to remain secured thereto in the absence of deliberate removal therefrom.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENTS

Figure 1:
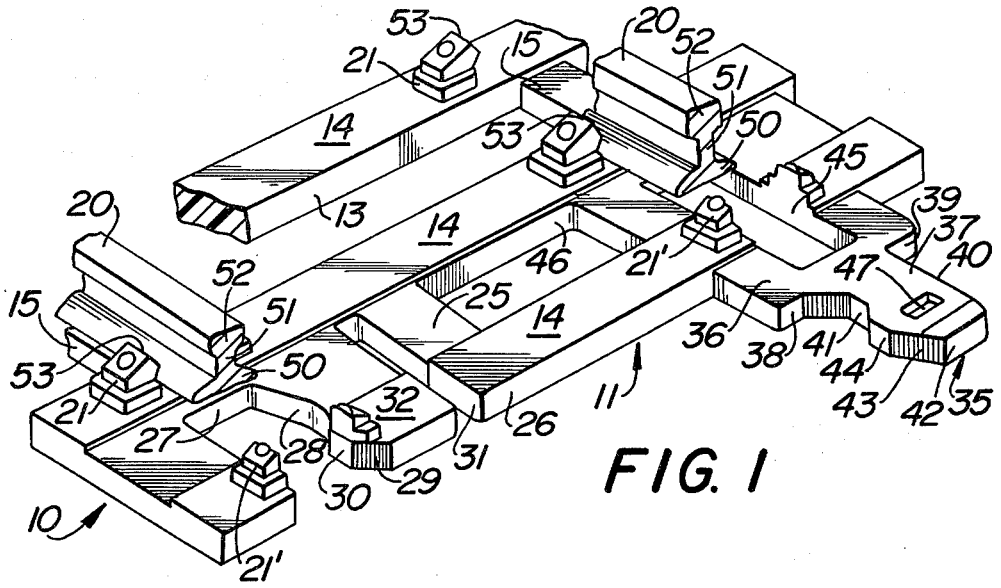
FIG. 1 is a partial, top perspective view showing an end region of a train track section of the present invention, broken away for clarity of illustration.
Figure 2:
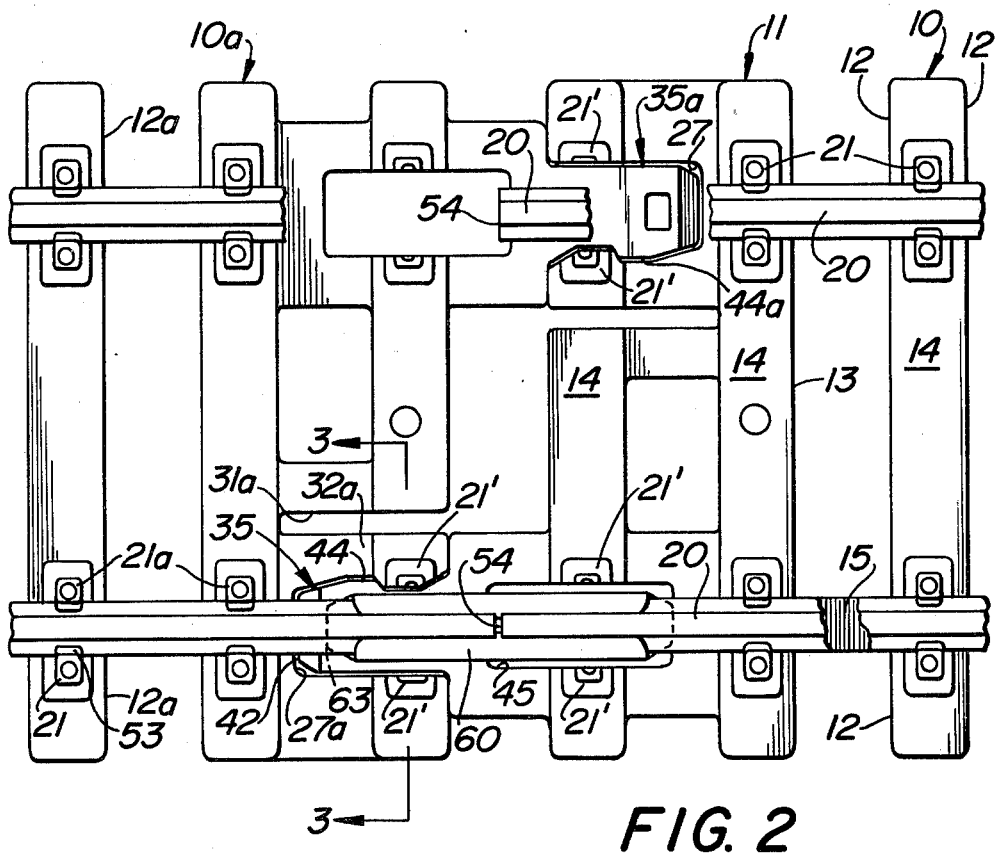
FIG. 2 is a partial top plan view showing a pair of like train track sections of the present invention joined together in end to end interfitting engagement, partly broken away for clarity.
Figure 6:
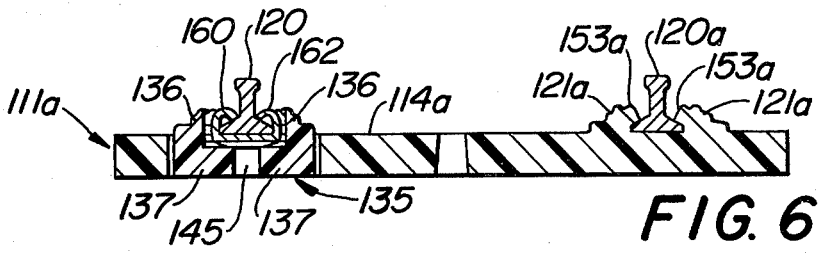
FIG. 6 is a transverse sectional view taken generally along the line 6—6 of FIG. 5.
Figure 7:
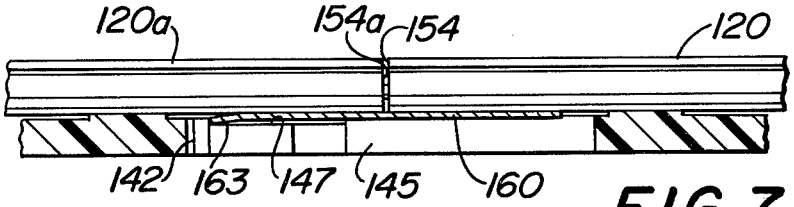
FIG. 7 is a partial longitudinal sectional view taken generallly along the line 7—7 of FIG. 5.
Figure 3:
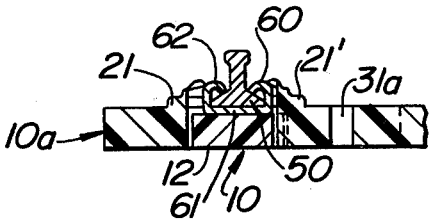
FIG. 3 is a partial transverse sectional view taken generally along the line 3—3 of FIG. 2.
Figure 4:
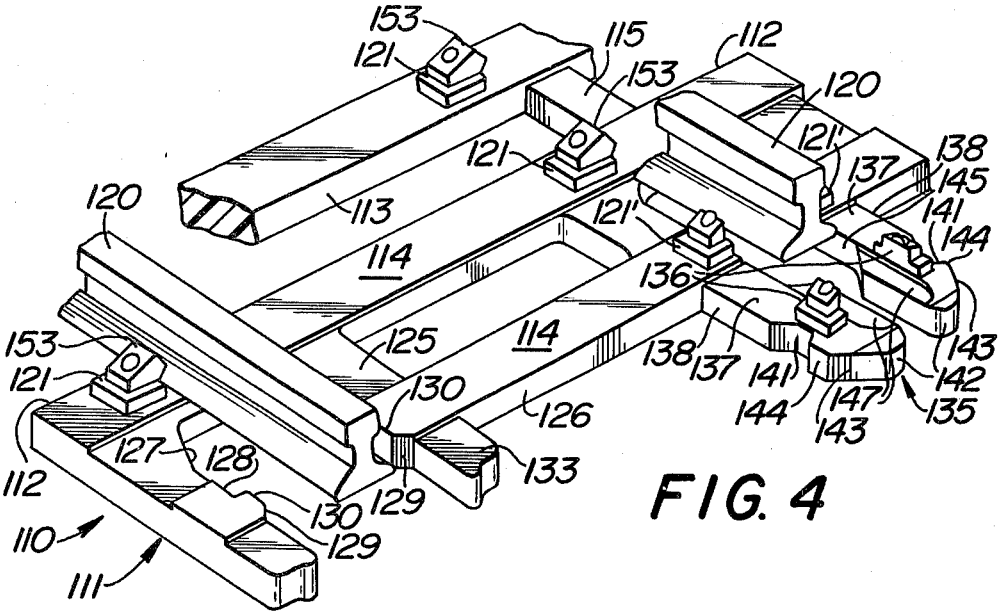
FIG. 4 is a partial top perspective view showing an end region of a slightly modified model train track section of the present invention, partly broken away for clarity.

Referring now more particularly to the drawings, and specifically to FIG. 1 thereof, a model train track section is there generally designated 10. In FIGS. 2 and 3 there is associated with the track section 10 a like track section 10*a*, wherein corresponding parts of the like track section are designated by corresponding numerals plus the letter "a".

The track section 10 includes an elongate plastic or otherwise non-conductive bed 11, which may be generally flat and of elongate straight, curved, or other desired configuration. In practice, the bed 11 may advantageously be automatically fabricated, as by injection molding, either in an elongate straight or curved configuration, as for forming straight or curved track sections. The lower and upper surfaces of the bed 11 may be generally flat, and substantially coplanar, while the bed may be provided with a plurality of side edge cutouts, as 12, and a plurality of intermediate cutouts 13, all configured and arranged to present the simulated appearance of railroad ties 14. That is, along each longitudinal side edge of bed 11 there are provided a plurality of side edge cutouts 12, with the cutouts of opposite side edges being in laterally spaced, aligned relation with each other. The laterally intermediate cutouts 13 are arranged in a row along the laterally intermediate region of bed 11, each laterally intermediate cutout 13 being laterally aligned with and in spaced relation between a pair of laterally aligned side edge cutouts 12. Thus, the laterally extending remaining bed regions 14 present the appearance of a plurality of generally parallel spaced railroad ties arranged in a row longitudinally of the track section 10 and each adjacent pair of simulated ties 14 is connected together by a pair of longitudinally extending laterally spaced bed portions 15.

A pair of longitudinally extending, parallel spaced track rails 20 are superposed on the bed 11, respectively directly over each series of aligned tie connecting bed portions 15 in crossing relation with the several ties 14. On the upper side of the bed 11, as on each simulated tie 14, there may be provided rail attachment means, as at 21, simulating the appearance of clamps serving to attach the rails 20 to the bed 11.

The opposite end regions of each bed 11 may be substantially identical, as best seen in FIG. 1. It will there be apparent that the end most simulated tie 14 is connected to the next endmost simulated tie 14 by a generally flat bed portion or web 25. The web 25 may extend between the pair of endmost simulated ties 14, and substantially between the ends thereof, except for certain cutouts and openings. Specifically, in general alignment with one aligned row of tie connecting portions 15, extending inwardly from the outer side 26 or end most surface of bed 11, there is formed a notch or cutout 27. On one side, the laterally inward side, the notch or cutout 27 is undercut, as at 28. The undercut inner side of cutout or notch 27 has its mouth or opening bevelled, as at 29, extending inwardly from the edge 26 to define between the bevel 29 and undercut 28 a lobe, protrusion or lug 30.

Spaced laterally inwardly from the cutout 27, adjacent to the undercut inner side thereof, there is formed a notch, slot or slit 31 extending longitudinally of the bed 11 inwardly from the bed edge 26 to a location adjacent to and short of the next adjacent simulated tie 14. The slot or kerf 31 is sufficiently close to the cutout 27 to leave the bed region therebetween, designated 32, at least slightly resilient, for resiliently yieldable deflection of the lug 30, for a purpose appearing presently.

Laterally spaced from the cutout or opening 27, in general alignment with the other series of aligned bed portions 15, there is provided generally coplanarly with the bed 11 a longitudinal or endwise extension or projection 35 projecting from and beyond the surface 26 of endmost tie 14. The end protrusion or extension 35 includes a generally rectangular inner portion 36 extending directly from and generally normal to the surface 26 of endmost tie 14, and a reduced terminal portion 37 extending from the inner portion 36 longitudinally outwardly of the bed 11, spaced laterally from the side edges of the inner portion. Thus, the terminal portion or reduced projection 37, being spaced laterally between the side edges of portion 36 defines on the latter a pair of longitudinally outwardly facing, repsectively laterally inner and outer shoulders 38 and 39. The reduced portion or extension 37 may have one side edge generally straight, as at 40, generally longitudinally of the bed 11, and may have its other, inner side provided with an undercut or recess 41, and which may extend longitudinally inwardly from its distal or outer end 42 in the manner of a bevel or chamfer 43. Thus, the region of extension 35 between undercut or recess 41 and bevel 43 may define a lateral protrusion or lug 44.

A through opening or hole 45 may be formed laterally medially in the projecting portion 36, extending inwardly therefrom through the adjacent portion of tie 14 and thence into the adjacent portion of web 45. Also, an opening or through hole 46 may be formed in the web 25, spaced between the endmost and next adjacent ties 14, and the opening 45 and slot 31.

Adjacent to the distal end 42 of extension 35, in the upper surface thereof, may be formed an opening or recess 47, for a purpose appearing presently.

The rails 20 may be substantially identical, each being fabricated of metal or other suitably conductive material and of a substantially constant cross sectional configuration throughout its length. In particular, each rail 20 may include a generally flat lower flange or base 50 which rests on and traverses the several ties, an upstanding intermediate region or web 51 upstanding from the base laterally medially thereof, and an enlarged upper portion or head 52.

The attachment means or simulated rail clamps 21, except those on the endmost tie 14 designated 21', are advantageously formed integral with the respective tie and configured to defined a tongue or lip 53 in overlying retaining engagement with the adjacent base portion 50 of rail 20. Thus, the lips or tongues 53 of the attachment means 21 serve to retain the rails 20 in position on the bed 11. The rails 20 are generally parallel to each other and coterminous. Each rail 20 terminates at a location approximately midway between the distal end 42 of extension 35 and the innermost region of cutout 27. Thus, as may be seen in FIG. 2, both of the rails 20 terminate at ends 54, laterally aligned with each other, which ends extend longitudinally outwardly beyond the endmost tie 14. Further, the simulated rail clamps or attachment means 21' of the endmost tie 14 are lacking in the retaining lip or tongue 53 of the attachment means 21, so that the end portions of rails 20 extending beyond the second endmost tie 14 are free of the bed, without restraint of one by the other.

Thus, the bed portion 32 is relatively free to flex toward the slot 31 for reduction of the latter. By this means upon end to end alignment of track section 10 with like track section **10*a*, the end extension 35 is aligned with the end cutout or receiver 27*a*, and similarly the end cutout or receiver 27 is aligned with the end extension 35*a*. Upon movement of the track sections 10 and 10*a* toward each other in their end to end aligned relation, the extensions 35 and 35*a* will enter into the receivers 27*a* and 27, respectively, during which the bosses or lugs 30 and 30*a* will be resiliently deflected laterally by respective bosses or lugs 44*a* and 44, for snap engagement thereby and resilient retention of the end extensions in respective end receivers. This is the condition shown in FIG. 2**, which is assumed by a mere straight line movement of one track section relative to another.

In addition, each rail 20 is provided on one end with a conductive rail connector or joiner 60. Specifically, the rail joiner 60 is fixedly attached to the rail end portion which terminates generally over the extension 35 when the rail sections are not connected. More specifically, the rail joiners or connectors 60 are permanently connected to the rail end portions which terminate over the bed openings 45. The rail connectors or joiners 60 may each include an elongate, upwardly facing clip having a bottom wall 61 engaged beneath the rail base 50, and upstanding spring flanges or fingers 62 on opposite sides of and engaging adjacent upper portions of the rail base. Further, the rail connectors or joiners 60 extend considerably beyond the end 54 of the rail 20, terminating adjacent to and just short of the distal end 42 of the end extension 35. A resilient lip or leaf spring 63 extends from the outer end of the bottom wall 61 of each joiner 60 for snap engagement into a nether recess 47, for positive retention thereby on the associated rail end portion. Thus, upon engagement and disengagement of like track sections, the rail connectors or joiners 60 will be retained on the proper rail end portions.

By the interfitting connection between end extensions 35, **35*a* and end receivers 27, 27*a*, inadvertent disconnection by vibration or other conditions of use is effectively prevented. Also, it will be apparent that the rail connectors or joiners 60 terminate short of the end extensions 35**, so as to preclude injury thereby to users.

Considering now the embodiment of FIGS. 4–7, there is shown therein a slightly modified embodiment of the present invention constituting a track section generally designated 110 and illustrating a like track section **110*a* having corresponding parts designated by corresponding numerals with the suffix "a". The track section 110 may include a generally flat, non-conductive base part or bed 111, which may be fabricated of plastic, say by injection molding, or otherwise fabricated of other suitable material. The bed 111 is generally elongate and provided on opposite side edges with a series of cutouts or notches 112, with the notches of opposite side edges being in respective laterally aligned relation with respect to each other. Additionally, bed 111 is provided, laterally medially thereof, with a longitudinal row of through holes or openings 113, each being elongate laterally of the bed and in respective alignment with and between a pair of laterally aligned side edge cutouts or notches 112**.

Thus, as in the first described embodiment, the bed material remaining between side edge cutouts 112 and laterally medial openings 113 define a plurality of parallel spaced, laterally extending simulated ties 114 arranged in a row longitudinally of the bed. Also, connecting the ties 114 are an aligned series or row of bed portions 115 adjacent to and spaced inwardly from each side edge of the bed.

Superposed over the bed 111, extending longitudinally thereof, are a pair of laterally spaced, parallel rails 120. The rails 120 may each overlie an aligned row or series of connecting bed portions 115, so as to obscure the latter, leaving visible only the rails and underlying transverse ties 114 to accurately simulate full size railroad track, in the same manner as the first described embodiment. Toward this end there are provided on the several ties 114, as by integral formation therewith, simulated rail clamps 121 in partially overlying and retaining engagement with the base portion of each rail 120. More specifically, each simulated tie 114 except the endmost tie 114 is provided with rail attachment members 121 which each include a retaining projection or lip 153 overlying the adjacent portion of the rail base and thereby retaining the rail in position on the bed. However, the endmost ties 114 include simulated rail clamps 121' which are not provided with retaining lips, and so do not function to retain or attach the rail 120 to the bed, but only as a clamp simulation.

Each end region of bed 111 is provided with a web or connecting portion 125 between the endmost and next adjacent ties. The endmost tie 114 may have its side edge 126 facing away from the next adjacent tie 114 and provided with a longitudinally inwardly extending opening 127 beneath one rail 120. More specifically, the cutout, opening or receiver 127 extends longitudinally inwardly of the bed 111 through endmost tie 114 and into web 125, terminating short of the next adjacent tie 114. The side walls of the cutout or receiver 127 are each undercut, as at 128, and provided with an internal projection or lug 130 which flares or chamfers outwardly, as at 129 to the tie surface 126. Additionally, extending from the tie surface 126 on opposite sides of cutout or receiver 127 are a pair of guide members 133 defining therebetween a guideway opening into the receiver 127. Laterally spaced from the receiver 127, generally beneath the other rail 120, the bed is provided with a dual or split end extension 135 projecting longitudinally outwardly from the bed end surface 126. The bed end extension 135 is subdivided or split by an opening 145 extending longitudinally of the bed inwardly through the end extension 135, thence through the endmost tie 114 and into the bed region 125 terminating short of the second endmost tie 114. The cutout or opening 145 subdivides the end extension 135 into a pair of laterally spaced resiliently deflectable fingers or detent elements 137. Each projection finger 137 may have its outermost or distal end 142 somewhat rounded and provided on its outer side with a bevel or chamfer 143 extending from the distal end 142. The outer surface or edge 138 of each spring finger 137 is notched or undercut, as at 141 spaced inwardly from the adjacent bevel 143 and combining therewith to define a laterally outstanding projection or lug 144.

The simulative but inoperative rail clamps 121' are located on opposite sides of the opening 145, on the endmost tie 114. An additional simulative but inoperative pair of rail clamps 136 are provided on the upper surfaces of spring fingers 137, each aligned with a respective rail clamp 121' longitudinally of the bed and spaced therefrom the approximate center-to-center spacing of the ties. The rail clamps 136 are lacking in the hereinbefore described retaining tongues so as to be simulative, but without the attachment function.

Additionally, the upper surfaces of spring fingers 137 are provided with recesses 147 opening laterally into the cutout 137, for a purpose appearing presently.

Figure 5:
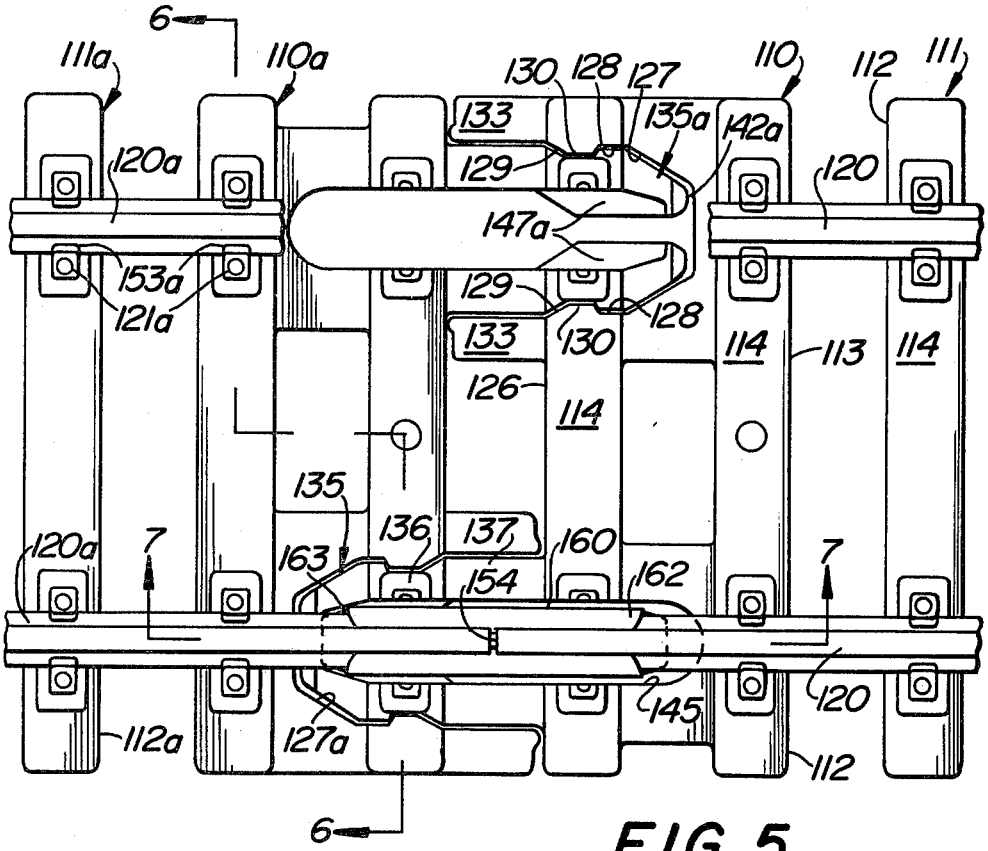
FIG. 5 is a partial top plan view showing a pair of model train track sections of FIG. 4 in end to end interfitting engagement, partly broken away for clarity.

As best seen in FIG. 5, the track section 111 is adapted for end to end interfitting engagement with an aligned, like track section 111*a*, wherein the longitudinal end extension 135 enters into and interfits within a longitudinal end receiver 127*a*, and similarly the longitudinal end receiver 127 receives in interfitting engagement a longitudinal end projection 135*a*. That is, each end projection 135 is laterally offset from the longitudinal centerline of the track section 110 a distance equal to the lateral offset of the end receivers 127 for mating engagement with the like track section 110*a*. Also, the end extension fingers 137 may resiliently flex toward each other for snap engagement of the finger lugs 144 past the receiver lugs 130 into a resilient retaining engagement therebetween. That is, the finger lugs 144 snap into the receiver undercuts 128, and the receiver lugs 130 snap into the finger undercuts 141. The track sections are thereby effectively retained in their aligned end to end interfitting relation throughout all conditions of use, while permitting of deliberate disconnection or separation by mere longitudinal withdrawal of the parts, one from the other.

As best seen in FIG. 5, the rails 120 are longitudinally coterminous, with their ends 154 located approximately midway longitudinally of the track section between the distal end 142 of an end extension, and the distal end 142*a* of a received end extension. Further, rail connectors or joiners 160 are provided on one end of each rail section 120. Specifically, the end portion of each rail section 120 over the cutout 145 of end projection 135 is provided with a rail connector or joiner 160. The rail connectors or joiners 160 may be substantially identical to the joiners or connectors 60 of the first described embodiment, and provided with spring clips 162 in retaining engagement with the rail base, and a resilient end tab 163 in self-retaining end engagement within recesses 147. Thus, the clips 160 are effectively positively retained in position on the rails 120 extending over the end extensions 135. That is, upon end engagement of like track sections 110 a rail end portion without a joiner 160 will enter into the extending end of a joiner 160, and withdraw therefrom upon track section disconnection leaving the joiner on its original rail end portion.

It will also be apparent that, in the disconnected track section condition, the rail end joiners 160 do not extend beyond their adjacent, underlying end extensions 135. Also, the rail end portions without rail joiners do not extend beyond their adjacent underlying guide members 133, so that there are no possibly injurious rail or connector extensions beyond the bed 111.

From the foregoing, it is seen that the present invention provides a model train track construction which includes the safety of having no sharp protrusions, is entirely vibration proof under all operating conditions while permitting of deliberate disconnection when desired, and wherein the rail connectors or joiners are effectively self-anchoring in position for ready track section connection and disconnection.

Although the present invention has been described in some detail by way of illustration and example for purposes of clarity of understanding, it is understood that certain changes and modifications may be made within the spirit of the invention.

What is claimed is:

1. A model vehicle track section comprising an elongate generally flat nonconductive bed, a pair of conductive rails superposed longitudinally on said bed, attachment means attaching said rails to said bed spaced from the ends of said bed, a longitudinal end extension on each end of said bed, the end extensions at opposite bed ends being laterally offset on opposite sides of a bed longitudinal center line, a longitudinally inwardly extending receiver at each bed end offset laterally oppositely to the adjacent end extension, said end extensions and receivers being configured for entry into and reception of end receivers and extensions of like track beds, resilient detent means on each adjacent pair of end extensions and receivers for snap interfitting end engagement between like track beds, and conductive open-ended sleeve-like rail connectors on one end of each rail for electrical connection to rails of a like track section, said connectors each overlying a respective end extension laterally inwardly thereof and terminating short of the underlying end extension to protect persons from said connectors, said rails being generally longitudinally co-extensive and terminating generally longitudinally midway between the entering end of the adjacent end extension and the entering end of an end extension of an interengaging like track bed.

2. A model vehicle track section according to claim 1, said resilient detent means being defined by the laterally inner side of each receiver being resiliently deflectable laterally inwardly, and formations on said laterally inner side of each receiver and one side of each extension for snap interfitting engagement with like track beds, said extension and the other side of each receiver being relatively rigid.

3. A model vehicle track section according to claim 2, said other side of said receiver extending laterally outwardly to the adjacent side edge of said bed.

4. A model vehicle track section according to claim 1, said resilient detent means comprising a pair of resiliently laterally deflectable fingers on each end extension, and formations on said fingers of each end extension and the inner sides of each end receiver for snap interfitting engagement with like track beds.

5. A model vehicle track section according to claim 4, the end portions of said rails extending beyond said rail attachment means, and said rail connectors receiving the rail end portions beyond said rail attacment means.

6. A model vehicle track section according to claim 1, said resilient detent means comprising a laterally opposed pair of resiliently deflectable sides on each end extension, and formations on each side of each end extension and on each side of each end receiver for snap interfitting engagement with like track beds.

7. A model vehicle track section according to claim 1, in combination with one-way snap retention means on said connectors and extensions for positive retention of the connectors in position on said rails, said connectors each comprising a sleeve, and said one-way snap retention means comprising a resilient tab extending from the outer end of each sleeve for outward and downward extension into snap interengagement with the underlying extension, said tabs serving to guide rails entering into said sleeves.

* * * * *